US007926427B1

(12) United States Patent
Ricks et al.

(10) Patent No.: US 7,926,427 B1
(45) Date of Patent: Apr. 19, 2011

(54) FORCE SENSITIVE COUPLER FOR TRAINS

(75) Inventors: Mark E. Ricks, Lincoln Park, MI (US); Neil Young, Woodside, CA (US); Louis G. Kovach, II, Belleville, MI (US); John T. Ricks, Lincoln Park, MI (US)

(73) Assignee: Liontech Trains LLC, Chesterfield, MI (US)

( * ) Notice: Subject to any disclaimer, the term of this patent is extended or adjusted under 35 U.S.C. 154(b) by 590 days.

(21) Appl. No.: 11/187,593

(22) Filed: Jul. 22, 2005

(51) Int. Cl.
*B61D 17/00* (2006.01)
*B61G 3/00* (2006.01)

(52) U.S. Cl. ..... 105/1.5; 213/77

(58) Field of Classification Search ..... 105/1.4, 105/1.5; 213/75 R, 77; 246/3, 6, 167 R, 246/187 R, 187 A, 218
See application file for complete search history.

(56) References Cited

U.S. PATENT DOCUMENTS

| | | | | |
|---|---|---|---|---|
| 4,838,173 | A * | 6/1989 | Schroeder et al. | 105/35 |
| 6,729,584 | B2 * | 5/2004 | Ireland | 246/122 A |
| 6,747,579 | B1 * | 6/2004 | Ireland | 341/34 |
| 7,404,362 | B2 * | 7/2008 | Webster et al. | 105/1.5 |
| 2006/0009117 | A1 * | 1/2006 | Severson | 446/410 |

* cited by examiner

*Primary Examiner* — S. Joseph Morano
*Assistant Examiner* — R. J. McCarry, Jr.
(74) *Attorney, Agent, or Firm* — O'Melveny & Myers LLP

(57) ABSTRACT

A model train car having a union with a force sensor is disclosed. The force sensor is configured to measure the amount of force acting on the coupler. The information gathered from the force sensor may work in conjunction with a communication link or a local control unit so that realistic train effects can be produced reflecting the change in force being felt by the model train.

12 Claims, 12 Drawing Sheets

Fig. 3A
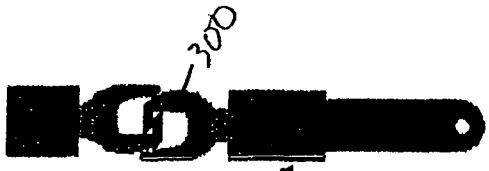
Fig. 3B
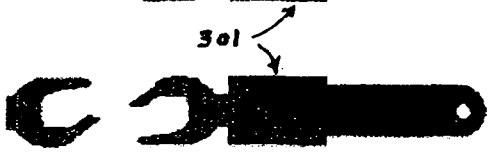
Fig. 4
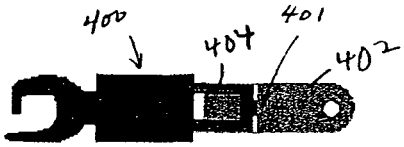
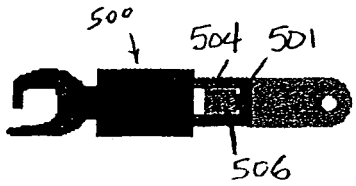
Fig. 5

Force sensitive resistor 710
compresses, force sensitive resistor 712
expands

Force sensitive resistor 710 expands,
force sensitive resistor 712 compresses

FORCE SENSITIVE COUPLER FOR TRAINS

CROSS-REFERENCES TO RELATED APPLICATIONS

NOT APPLICABLE

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

BACKGROUND OF THE INVENTION

The present invention relates to model trains, and in particular force sensors for model trains.

A variety of control systems are used to control model trains. In one system, the power to the track is increased, or decreased, to control the speed and direction of the train. Multiple trains can be controlled by providing different power levels to the different sections of the track having different trains.

In another type of control system, a coded signal is sent along the track, and addressed to the desired train, giving it commands such as speed and direction. The train itself controls its speed by converting the AC voltage on the track into the desired DC motor voltage for the train according to the received instructions. The instructions can also tell the train to turn on or off its lights, horns, etc. U.S. Pat. Nos. 5,441,223 and 5,749,547 issued to Neil Young et al. show such a system.

FIG. 1A is a perspective drawing of an example layout of a conventional model train system allowing the communication of signals from a base unit to a locomotive and other components.

A hand-held remote control unit 12 is used to transmit signals to a base unit 14 and to a power master unit 150 both of which are connected to train tracks 16. Base unit 14 receives power through an AC adapter 18. A separate transformer 20 is connected to track 16 to apply power to the tracks through power master unit 150. Power master unit 150 is used to control the delivery of power to the track 16 and also is used to superimpose DC control signals on the AC power signal upon request by command signals from control unit 12.

Power master unit 150 modulates AC track power to the track 16 and also superimposes DC control signals on the track to control special effects and locomotive 24'. Locomotive 24' is, e.g., a standard Lionel locomotive powered by AC track power and receptive to DC control signals for, e.g., sound effects.

455 kHz transmitter 33 of base unit 14 is configured to transmit an outgoing RF signal between the track and earth ground, which generates an electromagnetic field indicated by lines 22 which propagates along the track. This field will pass through a locomotive 24 and will be received by a capacity antenna located inside the locomotive.

FIG. 1B is a simplified schematic drawing of the conventional system shown in FIG. 1A. FIG. 1B shows a cross-sectional view of locomotive 24, which may be, e.g., a standard locomotive retrofitted or designed to carry antenna 26. The signal will then be communicated from antenna 26 to 455 kHz receiver 37 of engine 24. Locomotive 26 further includes a processor 84 in communication with receiver 37 and configured to interpret the received signal.

Returning to FIG. 1A, receipt of control signals is not limited to moving elements of the train set. The electromagnetic field generated by base unit 14 will also propagate along a line 28 to a switch controller 30. Switch controller 30 also has a receiver in it, and will itself transmit control signals to various devices, such as the track switching module 32 or a moving flag 34.

The use of both base unit 14 and power master unit 150 allows operation and control of several types of locomotives on a single track layout. Locomotives 24 which have been retrofitted or designed to carry receiver 26 are receptive to control signals delivered via base unit 14. Standard locomotives 24' which have not been so retrofitted may be controlled using DC offset signals produced by power master unit 150.

The remote unit can transmit commands wirelessly to base unit 14, power master unit 150, accessories such as accessory 31, and could transmit directly to train engines instead of through the tracks. Such a transmission directly to the train engine could be used for newer engines with a wireless receiver, while older train engines would continue to receive commands through the tracks.

Regarding force sensors, one type of pressure-sensitive input element is a resistor which senses force, such as the Force Sensing Resistor® (FSR®) available from Interlink Electronics. Such a resistor typically includes two conductors mounted on spaced apart substrates, with the substrates being compressed to close the gap and provide contact between the conductors. The signal output varies in accordance with the area of contact. An example is set forth in Interlink U.S. Pat. No. 5,302,936. Another pressure-sensitive force transducer is described in U.S. Pat. No. 4,489,302.

BRIEF SUMMARY OF THE INVENTION

The present invention provides a model train car containing a union that is used to connect one car to another car in a model train. These unions may connect locomotives to locomotives, locomotives to cars, or cars to other cars. Located within the union is a force sensor that is configured to measure the amount of force that is acting upon the union.

An embodiment of the present invention comprises a force sensitive resistor located within the union that connects one car to another car in a model train. As more force is placed upon the force sensitive resistor, the resistance changes accordingly, reflecting the change in force.

A further embodiment of the present invention comprises taking the information detected from the force sensitive resistor, and producing effects based the measured force. An example of a desired effect to be produced is a realistic train sound reflecting the strain of a locomotive pulling a large train.

A further embodiment of the present invention comprises a union containing two sensors to measure forces in positive and negative directions. Alternatively, a single sensor can measure the force in both directions. A spring is placed to apply a base force on the force sensor so that both negative and positive forces can be detected. The above mentioned configurations provide the ability to measure the force being felt by a model train.

BRIEF DESCRIPTION OF THE DRAWINGS

FIGS. 3A and 3B illustrate a typical coil coupler used in a model train system.

FIG. 4 illustrates a single sensor coupler design with unidirectional measurement capabilities, where a push force is measured.

FIG. 5 illustrates a single sensor coupler design with unidirectional measurement capabilities, where a pull force is measured.

DETAILED DESCRIPTION OF THE INVENTION

System

Figure 1A:
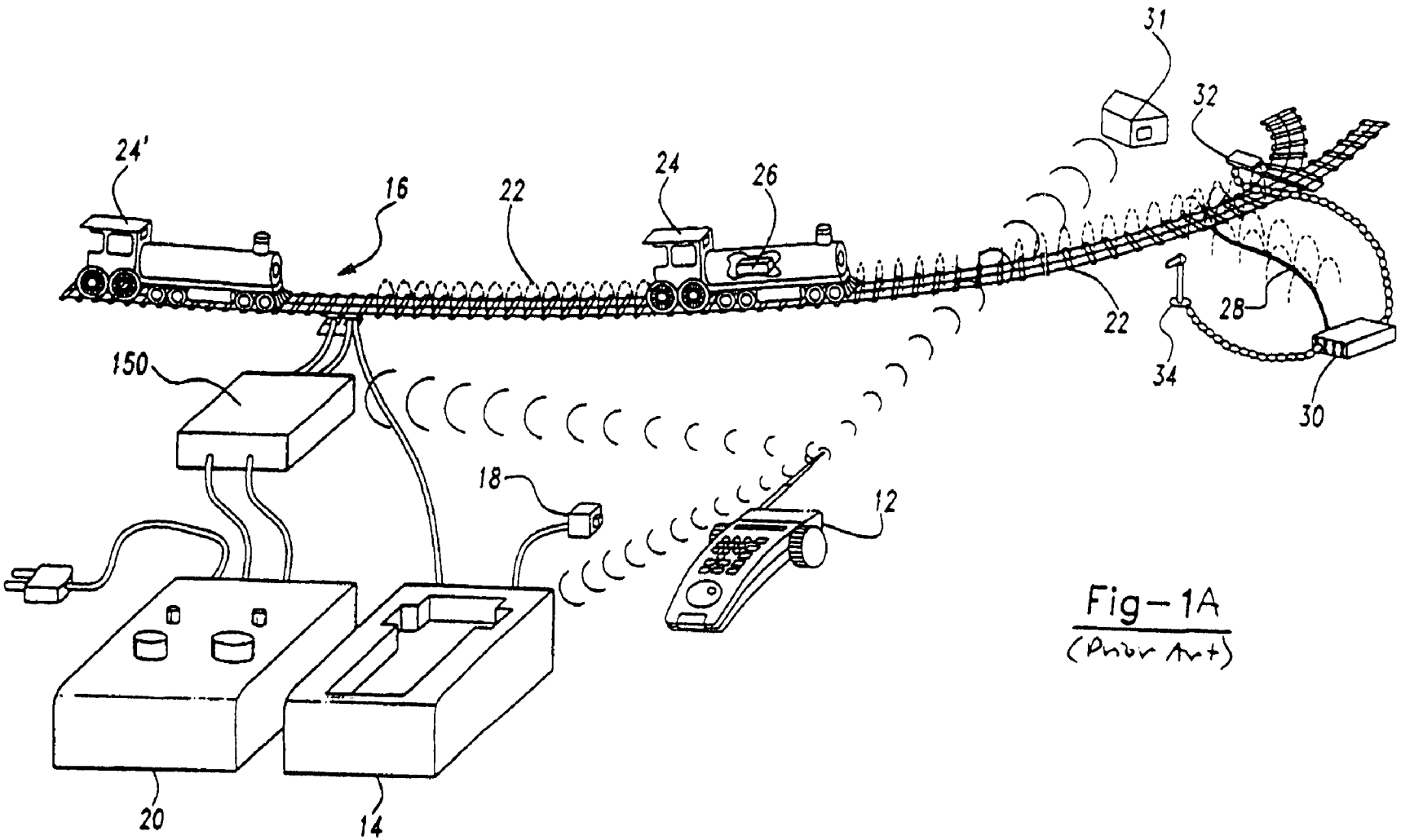
Fig-1A (Prior Art)
FIG. 1A illustrates a perspective view of an example of a model train system having commands transmitted to a train engine and accessories on the train layout.
Figure 1B:
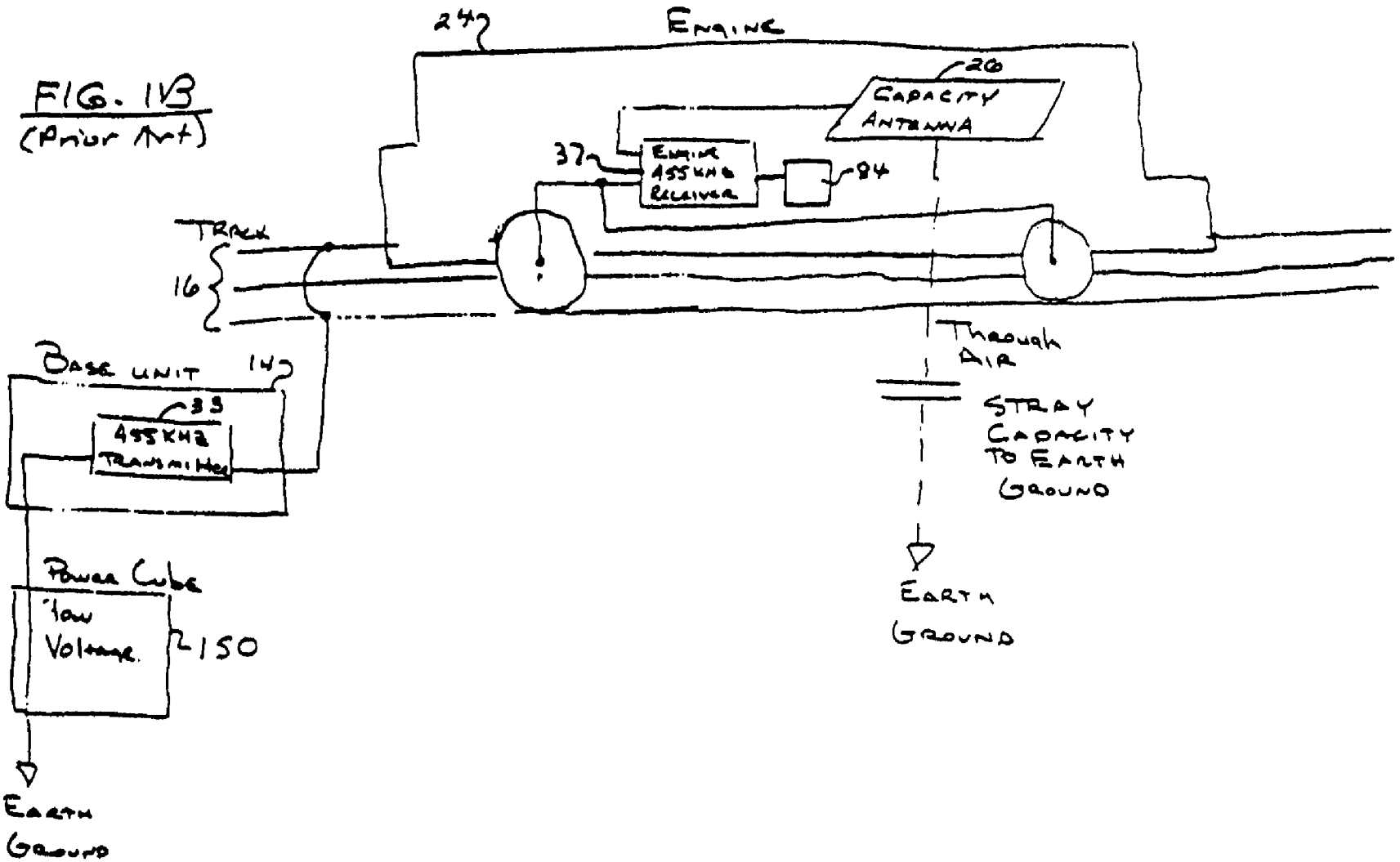
FIG. 1B (Prior Art)
FIG. 1B illustrates a simplified schematic view of the model train system of FIG. 1A.
Figure 2:
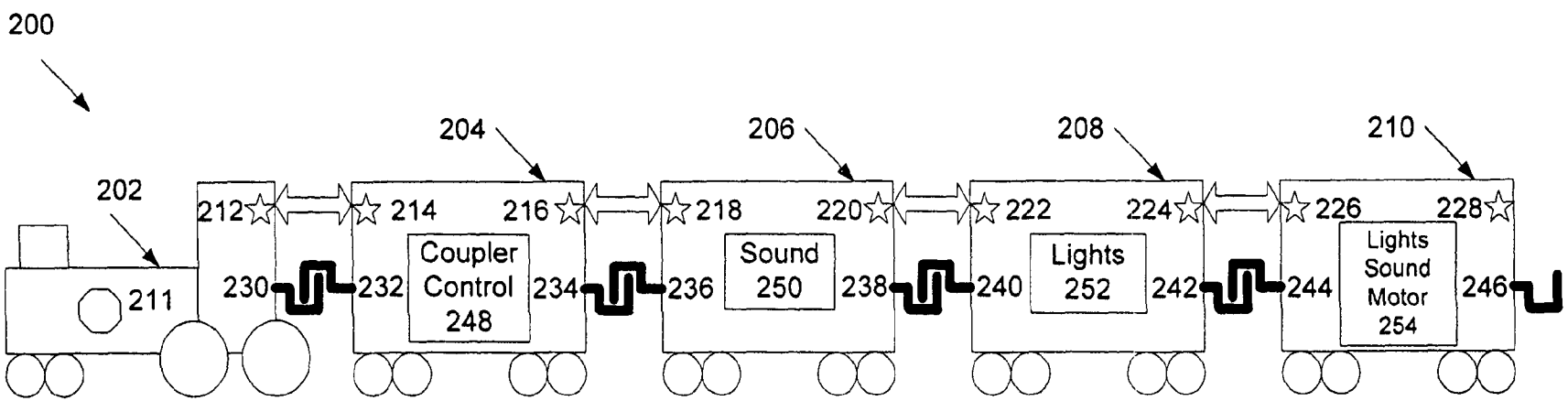
FIG. 2 illustrates an example of a model train system where a locomotive pulls the rest of the locomotive cars in a train.

FIG. 2 illustrates an example of an embodiment of a model train system. Locomotive 202 contains a motor to pull locomotive cars 204-210. Located between each car are two unions used to connect two neighboring cars together. A type of union may be a coupler. For example, coupler 230 of locomotive 202 is fastened with coupler 232 of first car 204. It should be appreciated that coupler designs are a commonly known art in the industry. FIG. 3 illustrates a typical coupler design where an electronic coil 301 provides the control to open the coupler. Electronic coil 301 closes on contact with another coil. Furthermore, a communication link may be established in the model train. The model train in FIG. 2 contains a series of wireless transceivers 212-228 which transfer data from car to car. Microprocessors or other circuitry may be located on each train car with the ability to process such data and forward this information through the communication link.

Coupler

FIGS. 3A and 3B illustrate a typical coupler. The coupler has a claw 300 for engaging the claw of another coupler. An electronic coil 301 controls the opening of the claw. FIG. 3A shows the closed position, while FIG. 3B shows the open position.

Single Sensor for Push or Pull Detection

FIG. 4 illustrates a perspective view of an example of a prototype sensor design to be used in accordance with the present invention. The system of FIG. 4 is compatible with the train shown in FIG. 2. FIG. 4 may represent a close up view of the couplers shown in FIG. 2. It may be appreciated that coupler 400 represents a larger scale view of coupler 232. However, coupler 400 is merely a coupler that connects any two neighboring rail cars in a model train, and can be located at any location in the rail car. Furthermore, the rail car could be motorized or non-motorized. FIG. 5, 6A, 6B, and 10 illustrate alternate single sensor designs which could represent coupler 232. In the single sensor design of FIG. 4, force sensor 401 is placed such that the force acting into the coupler is measured. Types of force sensors include, but are not limited to, force sensitive resistors, force sensitive strain gauges, etc. The 'push' force into coupler 400 is measured by force sensitive resistor 401. This type of measurement is also known as a unidirectional measurement, where only one direction is measured. The sensor 401 is placed between a first portion 402 of a cylinder and a loop 404. As a pushing force is applied against the coupler, the loop 404 is pushed up against portion 402 of the cylinder, exerting a measurable force on the sensor.

In the single sensor design of FIG. 5, force sensitive resistor 501 is placed such that the force acting away from the coupler is measured. In other words, the 'pull' force away from coupler 500 is measured. The sensor is placed on the other side of loop 504 from the position of FIG. 4, between loop 504 and portion 506 of the cylinder.

Single Sensor with Spring for Push and Pull Detection

Figure 6A:
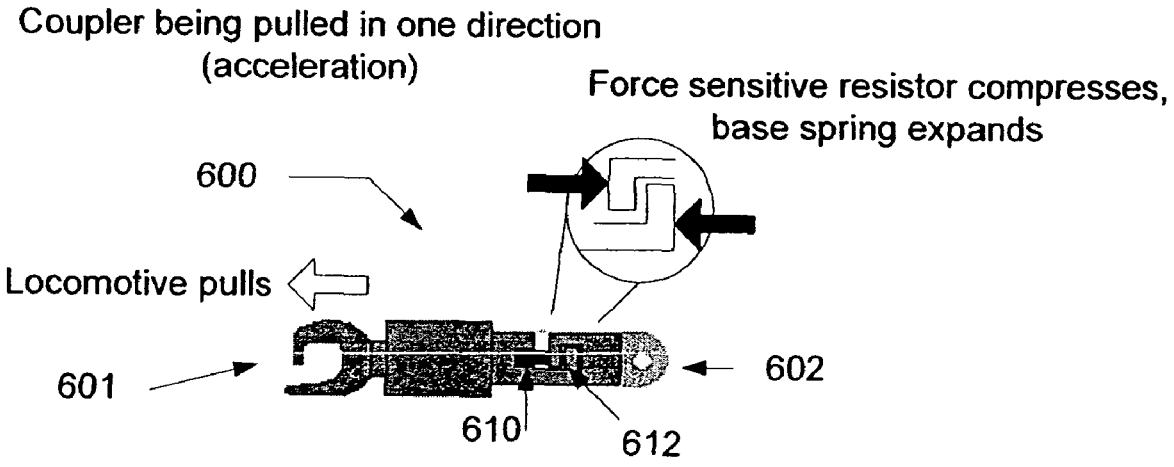
FIGS. 6A and 6B illustrate an example of a single sensor and spring design when the coupler experiences acceleration and deceleration.

FIG. 6A shows coupler 600 that contains moving fasteners 601 and 602 that allow for the coupler to move when pressure is applied. Fastener 601 of coupler 600 has the capability of being connected to another coupler, i.e. coupler 230 of locomotive 202. Fastener 602 of coupler 600 has the capability of being connected to a locomotive car, i.e. train car 204. Fastener 601 and 602 have some open space left between them so that some movement occurs when pressure is applied. Located within coupler 600 is force sensor 612. Force sensor 612 is configured to measure the amount of force that is acting on the coupler. An example of a force sensor is a force sensitive resistor.

Base spring 610 as shown in FIG. 6A is placed so that a base force is constantly being applied between fastener 601 and 602. When coupler 600 is static, this base force is recorded by force sensor 612 and this information is known by the control unit of a locomotive car as being the "base pressure" representing no movement. This point can also be represented by point 1101 on the resistance vs. force graph shown in FIG. 11. This configuration allows for the measurement of forces in positive and negative directions.

Force Sensitive Resistors

Figure 11:
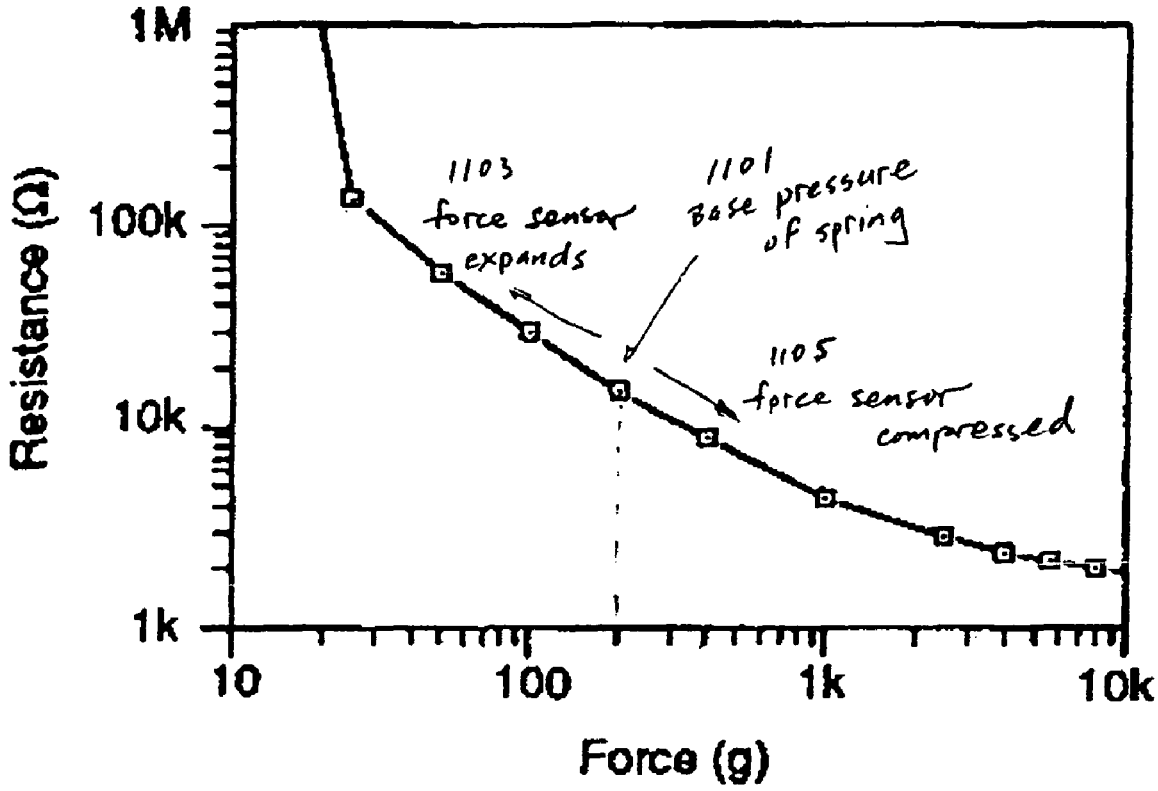
FIG. 11 illustrates a possible resistance vs. force relationship of an example of a force sensitive resistor.

Force sensitive resistors are also known as "Pressure Sensing", "Pressure Sensitive Resistors", etc. Force sensitive resistors are a type of resistor whose resistance changes when a force or pressure is applied. In one embodiment of a force sensitive resistor, the resistance is inversely proportional to the force applied, i.e. the resistance decreases as the force increases. FIG. 11 displays a possible relationship between the resistance and force. For example, when little force is applied to the sensor, the resistor has a resistance of 1 MΩ. As the force applied on the resistor increases, the resistance decreases accordingly. Furthermore, if a base spring is used, an 'equilibrium' point may correspond to point 1101 on the resistance vs. force graph. When the force sensor expands, the resistance increases along direction 1103 on the graph. On the other hand, when the force sensor is compressed, the resistance decreases along direction 1105 on the graph. Using such a graph allows for a force sensing resistor to accurately match a corresponding resistance to a particular force being applied to the resistor. Force sensitive resistors come in varying shapes and sizes. In one embodiment, a basic force sensitive resistor comprises a little round button. However, there are also force sensitive resistors that are long strips which can sense both position and pressure, and matrices exist which can sense x/y position and pressure.

One type of a force sensitive resistor is a piezoresistivity conductive polymer, which changes resistance in a predictable manner following application of force to its surface. It is normally supplied as a polymer sheet which has had the sensing film applied by screen printing. The sensing film consists of both electrically conducting and non-conducting particles suspended in matrix. The particle sizes are of the order of fraction of microns, and are formulated to reduce the temperature dependence, improve mechanical properties and increase surface durability. Applying a force to the surface of the sensing film causes particles to touch the conducting electrodes, changing the resistance of the film. As with all resistive based sensors the force sensitive resistor requires a relatively simple interface and can operate satisfactorily in moderately hostile environments.

Acceleration on Single Sensor and Spring Design

As locomotive 202 pulls the rest of train 200, fastener 601 is pulled in the same direction the locomotive pulls. It should be appreciated that any external component attached to fastener 601 may pull fastener 601 in this direction. In addition, spring 610 moves further apart and force sensor 612 detects a pressure being applied onto itself. As the pressure increases, the resulting electrical resistance of force sensitive resistor 612 decreases, represented by point 1105 on FIG. 11. Using a table similar to one shown in FIG. 11, the change in electrical resistance is found to represent a corresponding mechanical force being applied to the coupler. This information may be referred to as an input force signal, and is understood and used by a control unit. This information may be sent electronically via a communication link setup that is similar to that of a model train shown in FIG. 2. The force signal could also be measured from a mechanical mechanism within the union located on the model train car that allows for the force to be multiplied or divided by a ratio.

Deceleration on Single Sensor and Spring Design

Figure 6B:
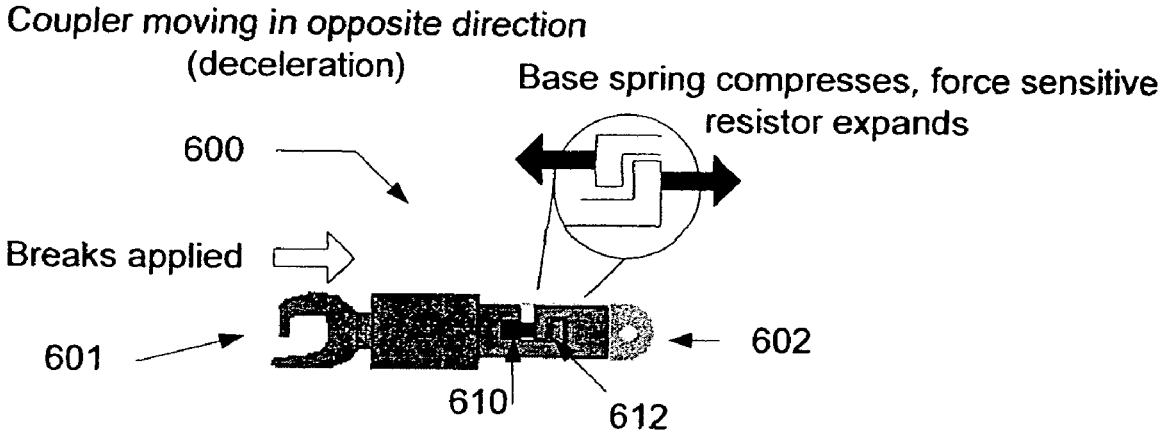

If the train were to decelerate by applying the breaks as shown in FIG. 6B, fasteners 601 and 602 would move towards each other, thereby causing base spring 610 to compress tighter, putting more space in between where force sensitive resistor 612 is located. The force measured at the point of deceleration would indicate a lower pressure than that of the "base pressure" because the base spring would be compressed more than its default position, represented by point 1103 in FIG. 11. The system would recognize that the low pressure below the base pressure reflects a negative force, i.e. the train is decelerating. Another example of the train decelerating include the train crashing into another train, whereby the velocity of the train would decrease at a large rate as a result of the crash.

Dual Sensor Design

Figure 7A:
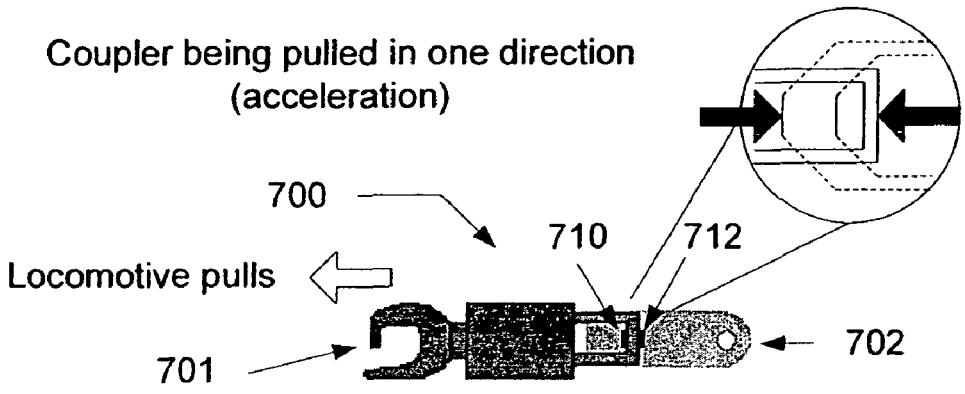
FIGS. 7A and 7B illustrate an example of a dual sensor design when the coupler experiences acceleration and deceleration.
Figure 7B:
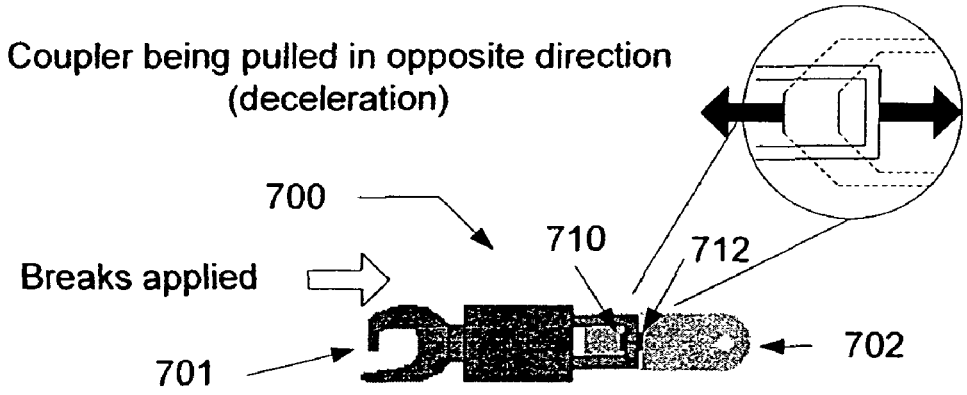

Alternately, two sensors could be used to provide a symmetrical bi-directional measurement on the push and pull force. FIGS. 7A and 7B illustrate such an example. Coupler 700 consists of fastener 701 and fastener 702 as shown in FIG. 7A. Force sensors 710 and 712 are placed such that when fastener 701 moves away from fastener 702 or vice versa, the pressure detected increases in force sensor 710 and the pressure detected decreases in force sensor 712. Likewise, when fastener 701 moves toward fastener 702 or vice versa as shown in FIG. 7B, the pressure increases in force sensor 712 and the pressure decreases in force sensor 710.

The use of two force sensitive resistors removes the need for a base pressure spring. It can be appreciated that fastener 701 represents the portion of coupler 236 of FIG. 2 which connects to another car, although fastener 701 may correspond to any coupler connecting to items pertaining to a model train layout. Fastener 701 could represent the portion of coupler 236 that connects to the train car. As locomotive 202 pulls the entire train, fastener 701 will move in a forward direction, i.e. in the same direction locomotive 202 pulls the entire train. It should be appreciated that any external component could pull fastener 701 in this direction. When fastener 701 moves in the forward direction, the pressure recorded by force sensitive resistor 710 will increase, while the pressure recorded by force sensitive resistor 712 will decrease. The pressure recordings from force sensors 710 and 712 can be processed by a microprocessor located on train car 206 and electronically sent via a communication link to another location, such as the microprocessor of locomotive 202. This information could be used for a variety of purposes, such as adjusting the motor speed in the locomotive until the pressure measured from force sensitive resistor 710 closely matches the pressure measured from force sensitive resistor 712. Other possible uses of the pressure readings include adjusting a realistic locomotive sound replicating motor strain, playing a "screeching" sound if the train decelerates very quickly, etc. An example of the coupler experiencing deceleration is shown in FIG. 7B. When coupler 700 experiences deceleration, force sensitive resistor 710 expands, while force sensitive resistor 712 compresses. As mentioned above, when such deceleration is experienced, this information could be sent to a sound system, where a dynamic breaking sound, or a "screeching" sound is played when the amount of deceleration exceeds a specified threshold.

Figure 8:
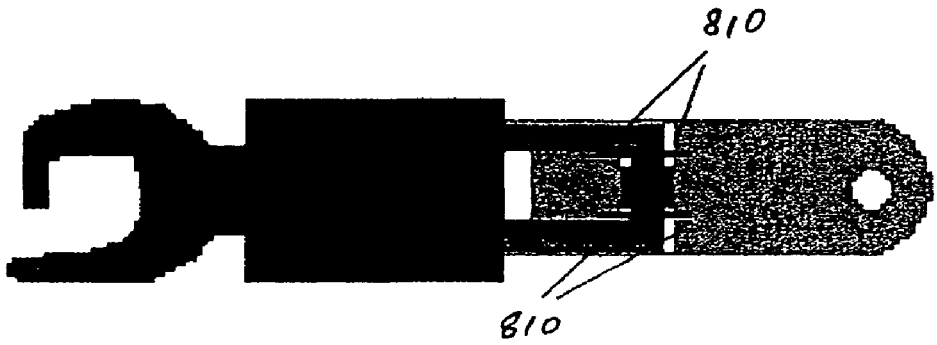
FIG. 8 illustrates an example of a dual sensor with centering springs design.
Figure 9:
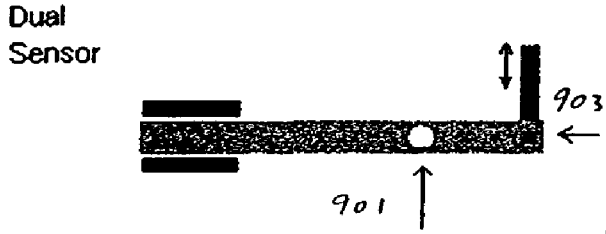
FIG. 9 illustrates an example of a dual sensor force ratio design which allows a ratio adjustment of the sensor range as a result of the pivot point being moved away from the force input point.
Figure 10:
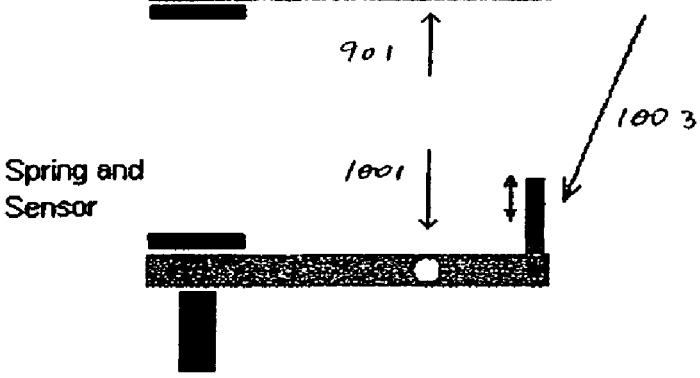
FIG. 10 illustrates an example of a single sensor and spring force ratio design which allows a ratio adjustment of the sensor range as a result of the pivot point being moved away from the force input point.

FIGS. 8 and 9 illustrate other possible dual sensor designs that encompass the present invention, although these designs in no way limit the embodiments of the present invention. The dual sensor design shown in FIG. 8 consists of centering springs 810 along beside the two sensors to center the entire coupler. The centering spring helps to center the coupler and keep the force at zero. The centering springs work in conjunction with the force sensors to resist the force acted upon them.

Pivot Point Design, Dual and Single Sensors

The dual sensor design shown in FIG. 9 consists of pivot point 901 located away from force input point 903 to allow for a ratio adjustment of the sensor range. The single sensor and spring force ratio design of FIG. 10 allows for a ratio adjustment of the sensor range by moving the pivot point away from the force input point.

Effects Based on Measured Force

There are several advantages to be gained from using force sensitive couplers in model trains. With the implementation of the present invention, a user will have the ability to know how much force a train is pulling and respectively how much work the motor of a locomotive is using. The present invention also provides the ability to know if a train is pulling uphill, downhill, or level when used with a known motor speed. Other capabilities of the present invention include determining the train momentum based on the force change during a change in motor speed, determining if a motorized or non-motorized rail car is connected to the front or back, or if it is the first or last in a sequence of cars, and determining if an engine that is stopped is being interacted with through couplers. Another advantage to the present invention involves the ability to lash any two locomotives together to create a train, i.e. two or more locomotives may be connected together to act as one. As the force sensitive coupler measures the resistance between the two locomotives, the motor output of both locomotives may be adjusted so that the resistance is minimized. Also, the present invention provides the ability to relay scale weight of train cars being pulled by the locomotive to the locomotive user. In other words, a group of three cars being pulled would require more force than merely pulling one car. The force sensor would be configured to be able to pick up difference in force required to move any number of cars. This information could be sent via a communication link to a transmitter for remote user control or any similar device, or stored on the rail car itself. It should be appreciated that other advantages may exist from using force sensitive couplers in model trains.

In addition to varying sounds in response to the pressure or force measurements, other effects can be generated. Smoke can be emitted in different quantities depending on the strain on an engine or the number of cars being pulled. The force data could be sent to a signal light accessory, having it flash a warning light earlier because the train with a lot of cars will take a long time to stop.

Electrical Circuitry

Figure 12:
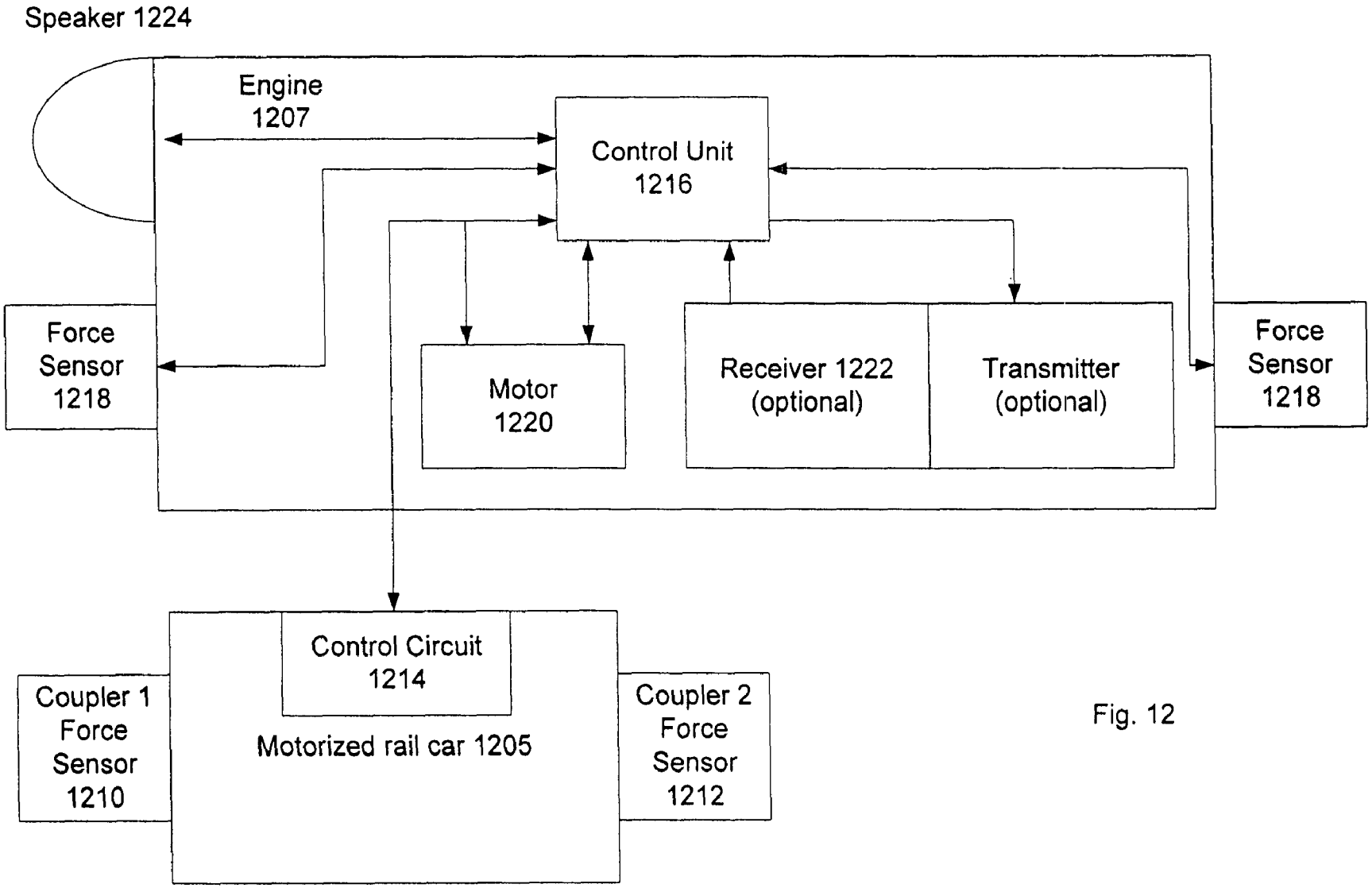
FIG. 12 illustrates a circuit diagram of the electronics involved in producing a sound effect as a response to the change in pressure from a force sensor in the model train system.

The electronic sound system of the model train is represented by the circuit diagram of FIG. 12. The detected force or pressure information may be sent to control unit 1216 and can be used to produce realistic sounds that reflect the strain of a motorized rail car. It can be appreciated that the information gathered from the change in electrical resistance could also be sent from the rail car to the remote control in the user's hand. For example, the force being applied to force sensor 1218 could be large when the locomotive is initially pulling the entire train. As a result, this information is sent through the communication link to an electronic sound producing system located on the model train. Control unit 1216 takes the information about the force being used by the locomotive motor 1220, and produces a slow "chug" sound signaling that the locomotive requires a great deal of work to move the entire train. As the train moves faster, the velocity of the entire train may become constant, and the force being measured by force sensitive resistor 1218 could record a lower force being applied, where this information can again be sent to the sound system and produce "chug" sounds at faster intervals. The force measurement could also be sent from control unit 1216 to transceiver 1222, and then to a remote control in the user's hand or to a stationary control unit. It should be noted that with the use of the base spring, force sensitive resistor 1218 has the capability of detecting the force being applied in both positive and negative directions, the positive direction being defined as the forward direction the locomotive is driving, and negative being the opposite of that direction.

The force sensing coupler system provides the ability to adjust the speaker output according to the coupler load to realistically replicate train sounds. As can be heard in real trains, as a locomotive begins to pull a large load, the sound of the motor makes a straining low pitch "chug" sound to break the threshold force needed to put the entire train in motion. FIG. 12 illustrates a circuit diagram of the electronic system used to generate such a sound effect. Train car 1205 contains force coupler 1210 on the front of the car, and force coupler 1212 on the rear of the car. Each coupler includes a force sensor which sends force measurement readings to control circuit 1214. Train car 1205 may or may not be linked to other model train components. Control circuit 1214 contains circuitry which can receive force measurements from train car 1205, or any following train car connected through a communication link. Control circuit 1214 sends commands to control unit 1216 which may be located in engine 1207. Control unit 1216 may contain the resistance vs. force 'lookup table' which relates the force measurement to a particular sound output. Depending on the force measurement sent from control circuit 1214, microprocessor sends the corresponding command to produce a sound to speaker 1224. Once the train has begun to move, less force is needed to keep the train in motion; thus, speaker 1224 of locomotive 1207 can produce a less straining high pitch "chug" sound. Furthermore, if a train car is improperly coupled, the present invention allows for the sound system to play a loud crash. For example, if a locomotive crashes into another car, the force sensor would pick up the large increase in force within a short period of time applied from the crash. As a result, the corresponding change in force could be sent to control circuit 1214, forwarded to control unit 1216, and speaker 1224 could produce a crash sound to reflect the large impact. Control unit 1216 can also pick up force measurements directly from motor 1220 located on engine 1207. In addition, control unit 1216 has the capability of relaying the force measurement information to transceiver 1222, where a remote control unit or base unit can process the information. Each train car may have two force sensors, and addressing of these force couplers may not be necessary. Two sensor readings could be available to control unit 1216.

Stationary Applications

Figure 13:
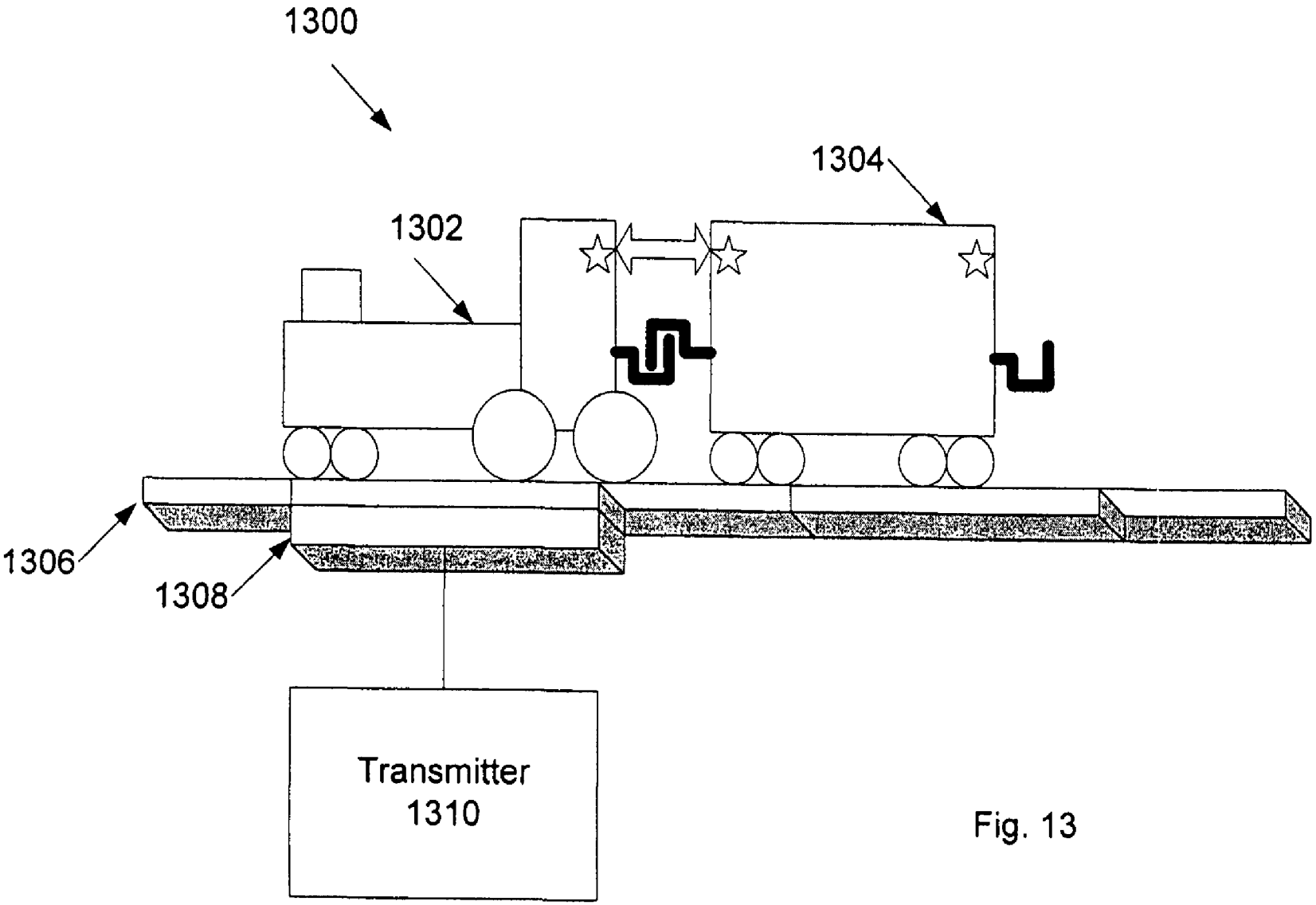
FIG. 13 illustrates an application of using force sensors with a weigh station where a force coupler is placed beneath a stationary piece of track.

In addition, there are stationary applications of using a force sensor in model train layout objects that encompass the present invention. For example, a weigh station could include a force sensor that is placed underneath a rail track to enable measurement of a train that passes over the track. FIG. 13 illustrates an example of a weigh station, where force sensor 1308 is placed underneath rail track 1306 so that when locomotive 1302 or any other train car were to pass over force sensor 1308, a force measurement is sent to transmitter 1310 to be processed in an alternate device or used locally to display weight to a user. Specific train cars could also be weighed to determine what type of products the train is carrying. Train cars carrying coal, water, logs, oil, automobiles, etc. could have corresponding weights that could be detected from the weigh station. Force sensor 1308 could also be placed within track switches, track bumping posts, model bridges, model houses (such as a round house), and model factories to produce similar measurements. Layout accessories dispersed along the train system could use this information to replicate realistic actions, such as light posts/traffic signals illuminating, a coal loader/coal power plant that only powers a model city as long as the coal is supplied, a saw mill/lumber factory that reports daily production based on the weight of the logs that were processed/dropped off, an oil refinery that reports daily production based on the weight changes in the oil containers when 'oil' is added, etc. Furthermore, force sensors could be placed in model train scenery objects, such as shrubs, trees, rocks, walls, buildings, fences, railings, road signs, etc.

Accessory (e.g., Crane) with Force Sensor

Figure 14:
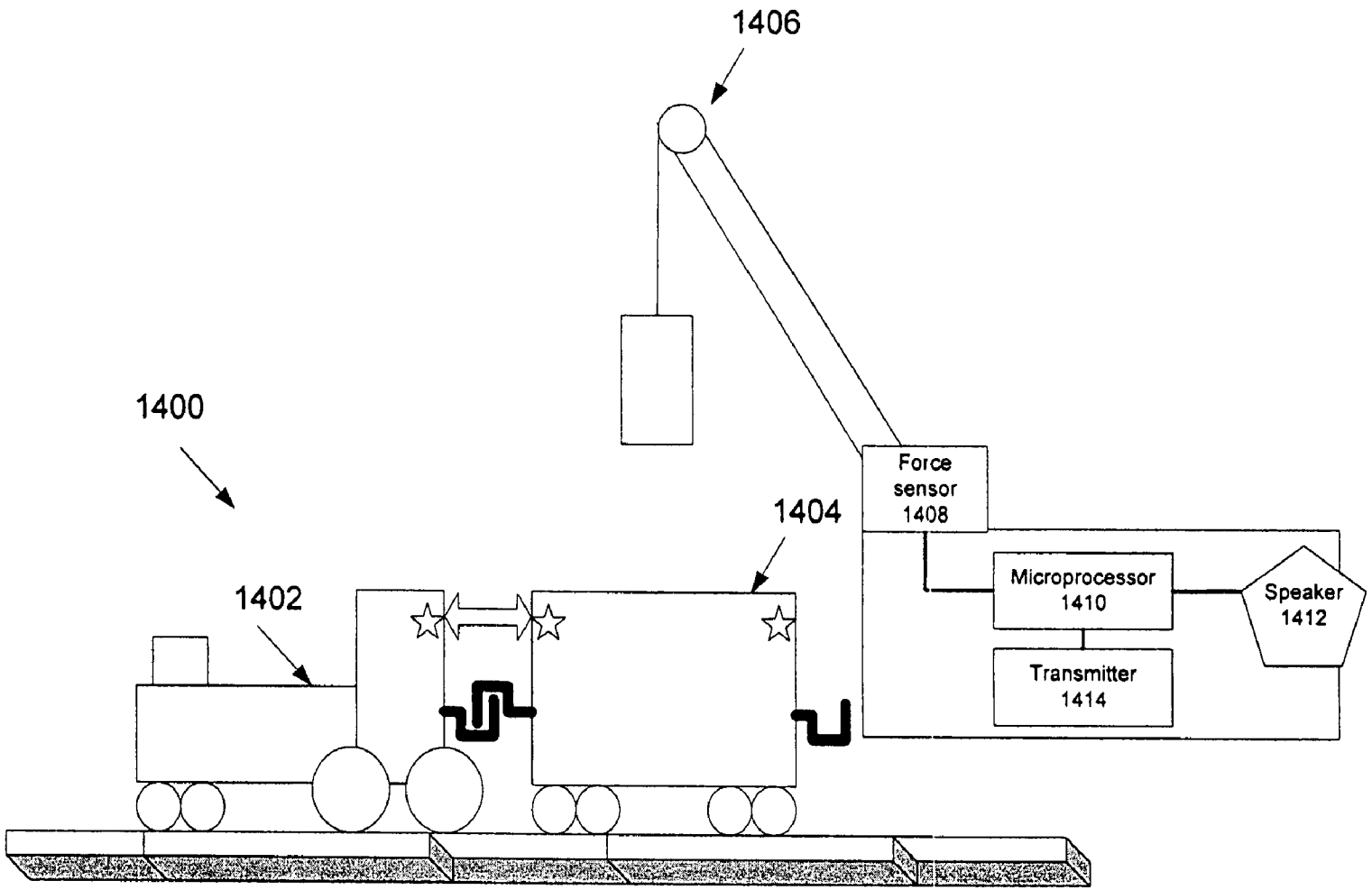
FIG. 14 illustrates an application of using force sensors with a crane used to pick up payload weight.

FIG. 14 depicts an example of a crane with a force sensor. The crane can pick up payload from particular train cars. Depending the payload weight, force sensor 1408 of crane 1406 could detect a particular force required to lift the payload, and send this information to control circuit 1410, where this information can be transmitted through transmitter 1414, a sound effect could be produced from speaker 1412, and the motor could be adjusted to realistically replicate crane performance. A specific example could be when a log loading accessory picks up logs and adjusts the sounds (motor strain, log loading, etc.) as the weight of the logs are detected. Other possible examples include placing force sensors in a construction vehicle such as a remote control dump truck loaded with a pressure sensitive dump bed configured to weigh the payload.

Force Sensor in Bumper

Figure 15:
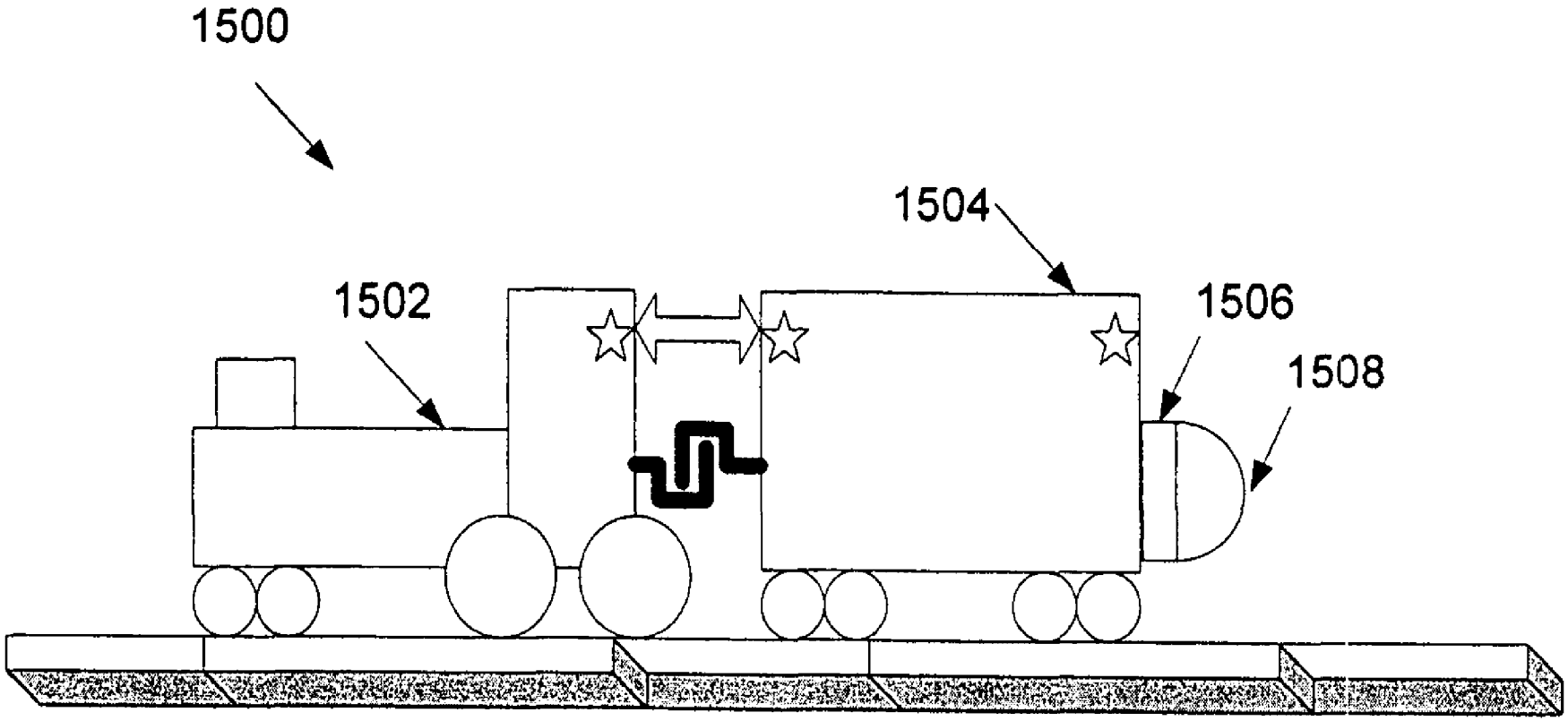
FIG. 15 illustrates an embodiment of the present invention where force sensors are placed at bumpers attached to the ends of train cars.

Another application is attaching a force sensor to a bumper on a train car, a remote control car, or any model train object, to detect collisions or adverse external forces, as shown in FIG. 15. Examples of model train objects are matchbox cars, construction vehicles, stationary model vehicles, battery powered cars that follow a wire hidden below a model road on a model train layout, etc. Force sensor 1506 is attached to bumper 1508 so that if a collision occurs, the abrupt change in force can be detected, and a realistic 'crash' sound or other effects can be produced.

Force Sensor on Motor

Depending on the force information, the motor could change its drive output in a realistic manner based on the train load. In simulating a real train, using force sensitive couplers in a model train system may provide the ability to measure maximum torque that a locomotive can exert before the wheels break free. This information can be stored on the train as "max pulling power recorded" data for later retrieval.

Dynamometer

Another application involves using the force sensor as a dynamometer. This application is similar to that of the force sensor on motor application described above except the force sensor is placed in a stationary object, where a train car couples to the stationary object and pulls as hard as possible (i.e., until the wheels are about to break), where some other monitored variables such as current draw, voltage, and current speed step could be used to produce performance statistics.

Alternate methods of measuring force on a model train system also exist which encompass the present invention. Without using a force coupler, (i.e., a coupler with a force sensor embedded inside) a force sensor could also be placed within another mechanism that connects the coupler to a train/car. In addition, a sensor could be placed within any force transferring point, which includes placing the sensor within the drive mechanism to measure strain, placing the sensor between a car truck and car/train (the wheels are set on the bottom of the train/car), mounting the drive motor with a force sensitive element to measure the torque/backdrive, etc. Further optional embodiments of the present invention include using a strain (bending) sensor in place of a force sensor, using a spring and location sensitive resistor/potentiometer to determine the force, using an accelerometer in place of a force sensor, etc. For example, the strain on the engine could be determined by measuring the voltage applied to the motor and the resulting acceleration. A low acceleration indicates a large load of cars, while a small acceleration indicates a small load of cars. In addition, a spring and switch or an array of switches could be used to sense pressure at preset thresholds.

It will be understood that modifications and variations may be effected without departing from the scope of the novel concepts of the present invention. For example, as used herein, the force sensor is meant to cover any type of sensor that measures force, pressure, or strain. Alternatively, an accelerometer could be used. Accordingly, the foregoing description is intended to be illustrative, but not limiting, of the scope of the invention which is set forth in the following claims.

What is claimed is:

1. A model train car comprising:

a union for connecting to unions of other model train cars, the union comprising a first portion and a second portion;

at least one force sensor connected between the first portion and the second portion of the union and configured to measure the amount of force acting on said union; and a control unit included in said model train car and adapted to receive force sensor data from the at least one force sensor and to use the force sensor data to produce at least one effect, wherein the effect is selected from a list of effects consisting of smoke, sound and light.

2. The model train car of claim 1, further comprising a communication link for transmitting the force sensor data to said model train car.

3. The model train car of claim 1, wherein said force sensor is configured to measure forces in positive and negative directions.

4. The model train car of claim 1, wherein said force sensor comprises a force sensitive resistor.

5. The model train car of claim 1, wherein said force sensor comprises a force sensitive strain gauge.

6. The model train car of claim 1, wherein the control unit is further adapted to use the force sensor data to produce at least one sound.

7. The model train car of claim 1, further comprising a mechanism within said union that allows force to be multiplied or divided by a ratio.

8. The model train car of claim 1, further comprising a spring configured to apply a base force to said force sensor in said union, wherein said force sensor is configured to measure forces in positive and negative directions.

9. The model train car of claim 1, wherein the control unit is further adapted to use the force sensor data to produce at least one quantity of smoke.

10. A model train layout object comprising:

a body;

a force sensor mounted on said body at a position for measuring a force against said body; and a control unit included in said body and adapted to use at least force sensor data from the force sensor to produce at least one effect, the effect being selected from smoke, sound and light.

11. The model train layout object of claim 10, wherein the effect comprises sound.

12. The model train layout object of claim 11, further comprising a bumper mounted over said force sensor to measure the force acting upon said bumper.

* * * * *